US005261305A

United States Patent [19]

Nasu

[11] Patent Number: 5,261,305

[45] Date of Patent: Nov. 16, 1993

[54] APPARATUS FOR CUTTING LAMINATE

[75] Inventor: Nobuo Nasu, Fukuyama, Japan

[73] Assignees: Kabushiki Kaisha Kawakami Seisakusho; Namx Ltd., both of Hiroshima, Japan

[21] Appl. No.: 989,166

[22] Filed: Dec. 11, 1992

[30] Foreign Application Priority Data

Dec. 16, 1991 [JP] Japan ..... 3-331643

[51] Int. Cl.[5] ..... B26D 1/06

[52] U.S. Cl. ..... 83/427; 83/428; 83/435.2; 83/451; 83/940; 83/152; 83/433

[58] Field of Search ..... 83/451, 271, 940, 936, 83/427, 428, 433, 435.2, 318, 319, 320, 152, 939

[56] References Cited

U.S. PATENT DOCUMENTS 3,350,970 11/1967 Glastra ..... 83/435.2
3,587,381 6/1971 Sederberg ..... 83/428
3,589,225 6/1971 Wiatt ..... 83/427
5,018,418 5/1991 Nasu ..... 83/271

*Primary Examiner*—Eugenia Jones
*Assistant Examiner*—Allan M. Shrock
*Attorney, Agent, or Firm*—Ladas & Parry

[57] ABSTRACT

A laminate placed on a supporting belt is covered with an air-impermeable sheet, then compressed by sucking air from sucking mechanisms, and the laminate is cut by a cutter which is supported at two locations. A belt retaining mechanism comprises a number of belt support plates for supporting a belt, support posts extending downwardly therefrom, and receiving plates supported by a receiving plate retaining mechanism disposed on longitudinal beams. A travel body and cam plates are operatively connected, and the support posts are supported on the receiving plates at a location other than a cam groove of each cam plate to stabilize the belt support plates. The receiving plates are separated within a movable recess of the belt, so that the support plates are raised by the cam groove.

1 Claim, 7 Drawing Sheets

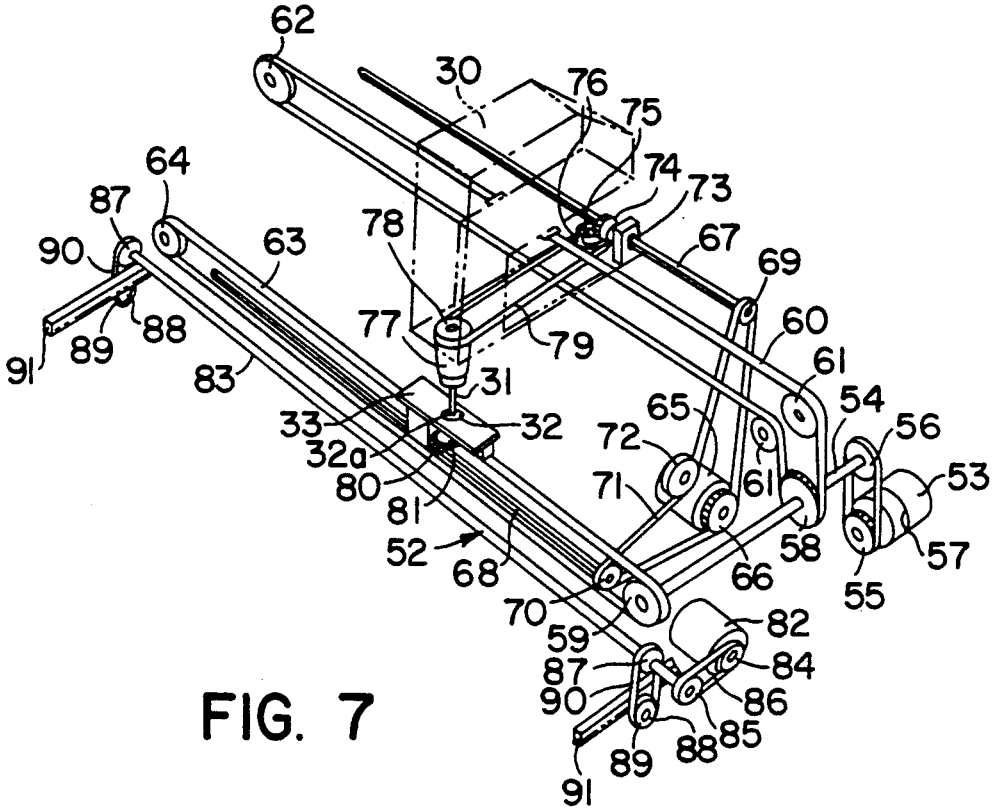
FIG. 7
FIG. 8
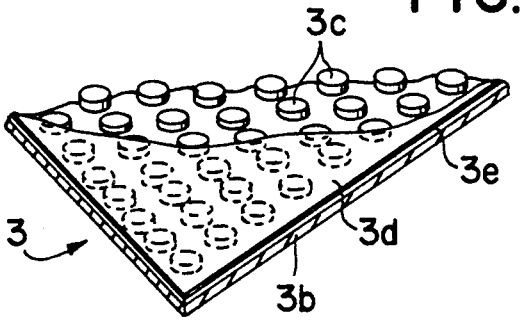

APPARATUS FOR CUTTING LAMINATE

BACKGROUND OF THE INVENTION

This invention relates to a laminate cutting apparatus for automatically cutting a laminate consisting of multiple plies of a sheet material such as a fabric.

Heretofore, an automatic laminate cutting apparatus of the type mentioned above is disclosed in, for example, Japanese Patent Publication No. Sho 53-13836. In this conventional apparatus, a laminate such as a fabric to be cut is supported on a supporting surface of an air-permeable support member, and by withdrawing air from the under surface of the support member, the laminate is supported on the supporting surface in a compressed state. In that state, a knife-like cutter as a cutting tool is penetrated into the laminate from above, so that the laminate is cut into a desired shape.

The inventor of the present invention has also proposed a laminate cutting apparatus as discussed in Japanese Patent Application Laid-Open (KOKAI) No. Hei 1-306200. This conventional cutting apparatus includes a pedestal, a belt support mechanism provided with a number of belt support plates arranged in parallel in the longitudinal direction (forward and backward direction), a laminate supporting belt supported on the pedestal through the belt support mechanism and capable of reciprocating longitudinally, and a travel body supported on the pedestal and capable of reciprocating longitudinally. The travel body is provided with a recess forming member for forming a movable recess having an open upper surface in a longitudinal part of the support belt, a cutter head capable of reciprocating transversely above the support belt, and a cutter receiving sleeve capable of reciprocating transversely within the movable recess in synchronism with this cutter head. A knife-like cutter is mounted on the cutter head with its tip portion inserted into the cutter receiving sleeve such that the cutter is capable of moving up and down. The pedestal is provided on both sides thereof with suction ducts having suction ports opening up at their opposing surfaces.

With this cutting apparatus, an air-permeable laminate such as a fabric, which is covered at all surfaces excepting side surfaces thereof with an air-impermeable sheet, is supported on the supporting belt, and air is withdrawn from both side surfaces of the laminate through the suction duct, so that the laminate is held in a compressed state on the supporting belt.

In that state, the cutter is lowered to insert its tip portion into the cutter receiving sleeve, the cutter head is reciprocated transversely, and the travel body is reciprocated longitudinally, whereby the laminate is cut into a desired shape.

The belt support mechanism has a cam plate and the belt support plates each of which is provided with an elevating mechanism. This elevating mechanism is provided with rack bars each having a round shape in section. The rack bars are hung down from two transverse locations of the under surface of the belt support plates respectively. Pinions meshed with the rack bars are fixedly secured to both end portions of a connecting shaft which, in turn, is rotatably horizontally supported by a support plate retaining member secured to the pedestal through a bearing. The connecting shaft is provided with a brake. The brake is operated to be released, only when necessary, by means of electrical control using electricity, air, hydraulic pressure, etc.

Usually, the connecting shaft is locked to the retaining member so that the support plate can maintain its raised state. The retaining member is provided with a clamp member adapted to slidably support the rack bars.

For moving the movable recess, the support plates, which support the under surface of the supporting belt at a front location of the travel body, is brought into a state able to be lowered owing to release of the brake caused by suitable means for detecting approach of the cam plate which is secured to the travel body under traveling. Subsequently, rollers rotatably attached to the support plates are brought into engagement with a cam groove, which is formed in the cam plate, in accordance with traveling of the travel body. As traveling of the travel body proceeds, the support plates, while maintaining their horizontal postures, are lowered below the movable recess. The support plates located below the movable recess are raised, one after another, first from one located behind guided by the cam groove in accordance with traveling of the travel body. When the support plates are separated from the cam plate, they support the under surface of a supporting portion of the supporting belt. In that state, the brake stops its releasing action to lock the raised position, and then this locked state is maintained. Therefore, in accordance with the movement of the movable recess, the support plates, which are bought below the movable recess, are gradually changed one after another. Simply with the change of the support plates, only the support plates corresponding longitudinally to the cam plate are located below the movable recess and the under surface of the supporting belt is normally supported by the number of remaining support plates.

Since the laminate cutting apparatus shown in the afore-mentioned Publication No. Sho 53-13836 is a cantilever type cutter in which the laminate retained in a compressed state on the supporting surface by suction is penetrated by the knife-like cutter and the tip portion of the cutter is also penetrated in the area near the supporting surface of the support member, the tip portion of the cutter is twisted by resistance of the laminate and support member. The result is that a cut product of high accuracy is difficult to obtain. A band saw type cutter is sometimes used as a cutting tool. In this case, however, when the laminate is cut by the cutter, the laminate and the support member are simultaneously cut by the cutter. Since it is necessary to change the support member highly frequently, the working ratio is bad.

On the other hand, the laminate cutting apparatus disclosed in the second-mentioned Publication No. Hei 1-306200 is complicated in structure because the belt support mechanism for supporting the laminate supporting belt has the belt support plates provided with the rack bars, the pinions and the brakes. Moreover, since the brakes are controlled by the electrical means, there is a fear that failures are likely to occur.

SUMMARY OF THE INVENTION

It is therefore an object of the present invention to provide, in order to obviate the above problems, a laminate cutting apparatus, in which a cut product of high accuracy can be obtained easily and efficiently, the structure of a belt support mechanism is simple, compact and light in weight, a failure is seldom to occur, and a stable operation can be obtained.

To achieve the above object, there is essentially provided a laminate cutting apparatus, comprising: a pedestal; a laminate supporting belt mounted on the pedestal through a belt support mechanism and capable of reciprocating longitudinally; a travel body supported on the pedestal and capable of reciprocating longitudinally; the travel body being provided with a recess forming member for forming a movable recess having an open upper surface in the supporting belt, a cutter head capable of reciprocating transversely above the supporting belt, a cutter receiving sleeve capable of reciprocating transversely within the movable recess in synchronism with the cutter head; a knife-like cutter mounted on the cutter head with a tip portion thereof inserted into the cutter receiving sleeve such that the cutter is capable of moving up and down; and a suction mechanism for compressing the laminate on the supporting belt; wherein the belt support mechanism, comprising: a number of belt support plates linked in the longitudinal direction so as to be free to flex and adapted to support an under surface of the supporting belt; belt support plates located at front and rear ends, among the number of belt support plates, being connected to front and rear end portions of the pedestal so as to be free to flex; a pair of horizontal longitudinal receiving beams disposed along the longitudinal direction of the pedestal; a receiving plate retaining mechanism: a number of receiving plates retained by the longitudinal beams so as to be capable of being inserted therein and retreated therefrom through the receiving plate retaining mechanism; a pair of support posts extending downward from each of the belt support plates and supported by the receiving plates at a portion other than the movable recess and its vicinity; a cam plate secured to both side members of the travel body and provided with a cam groove surrounding the movable recess; rollers disposed at the belt support plates respectively and supported on an upper surface of the cam groove; and sweeping boards secured to the both side members of the travel body and adapted to retract the receiving plate opposing the cam groove through engagement with the retaining mechanism.

In the operation of the laminate cutting apparatus of the present invention, a laminate consisting of multiple plies of a sheet material such as a fabric is placed at a predetermined position on the laminate supporting belt, and a portion of this laminate exposed to atmosphere is covered with a flexible air-impermeable sheet. In that state, by sucking air from the suction ports of the suction ducts, the laminate and the air-impermeable sheet are held on the supporting belt in a compressed state.

The above state is maintained, and the knife-like cutter is penetrated into the air-impermeable sheet and the laminate with the tip portion of the cutter inserted into and retained by the cutter receiving sleeve. In accordance with the transverse movement of the cutter head disposed at the travel body and with the longitudinal traveling of the travel body, the movable recess formed in the supporting belt and the cutter receiving sleeve disposed within the movable recess are moved in the longitudinal and transverse directions respectively in unison with the travel body and the cutter head, in order to perform a cutting operation to the laminate.

According to the present invention, since the cutter is supported at upper and lower locations thereof and performs a cutting operation in that state, even if the laminate is cut into a complicated shape including an acute angle using a thin cutter, deformation owing to twisting of the cutter is seldom. As a result, a cut product of high accuracy can be obtained.

Furthermore, in the present invention, it suffices that the number of belt support plates disposed at the belt support mechanism are linked in the longitudinal (forward and backward direction) so as to be free to flex, and these support plates are provided with the support posts extending downward and the rollers supported on the upper surface of the cam groove formed in the cam plate. The receiving plate retaining mechanism for retractably inserting the receiving plates into the longitudinal beams of the pedestal is also simple in structure. Therefore, it is not necessary for the number of belt support plates to be provided with the rack bars, the pinions, and the brakes. Therefore, the belt support mechanism of the present invention is simple in structure compared with the conventional belt support mechanism. Also, contrary to the prior patent application filed on Nov. 27, 1991 by the present applicant in which a number of transversely superposed carrier plates are provided and therefore the transverse size is large and the weight is heavy, the cutting apparatus of the present invention does not have the carrier plates and therefore can be made small in size and light in weight.

Furthermore, in the present invention, the belt support plates for supporting the under surface of the laminate supporting belt are linked in the longitudinal (forward and backward) direction so as to be free to flex, the receiving plates are retractably inserted into and retained by the horizontal longitudinal beams disposed longitudinally of the pedestal, and the support posts extending downward of the belt support plates are supported on these receiving plates when at a portion other than the movable recess and its vicinity, while at the movable recess and its vicinity, the rollers mounted on the belt support plates are supported on the upper surface of the cam groove of the cam plate which is secured to the travel body. Accordingly, the cam plate and the sweeping board are moved in unison with the travel body and brought into engagement with the receiving plate retaining mechanism which has been brought to position where the sweeping board and cam plate are located, in order to retract the receiving plates opposite the cam groove. By this, the receiving plates are separated from the support posts which are inserted into the movable recess and its vicinity, the belt support plates are lowered, the belt support plates located at the movable recess and its vicinity are supported on the upper surface of the cam groove through the rollers, and the belt support plates, which are out of the movable recess and its vicinity, are raised again by supporting the support posts on the receiving plates which are inserted as a result of disengagement between the sweeping noard and the retaining mechanism.

Therefore, the belt support plates can be maintained normally in a stable state, and the belt support plates can be raised and lowered by mechanical means through the cam groove portion without using any electric means.

BRIEF DESCRIPTION OF THE DRAWINGS

FIG. 7 is a perspective view showing a drive system of the cutting apparatus of FIG. 1;

FIG. 8 is a partial perspective view showing a modified example of a supporting belt of the present invention;

DESCRIPTION OF THE PREFERRED EMBODIMENTS

Figure 1:
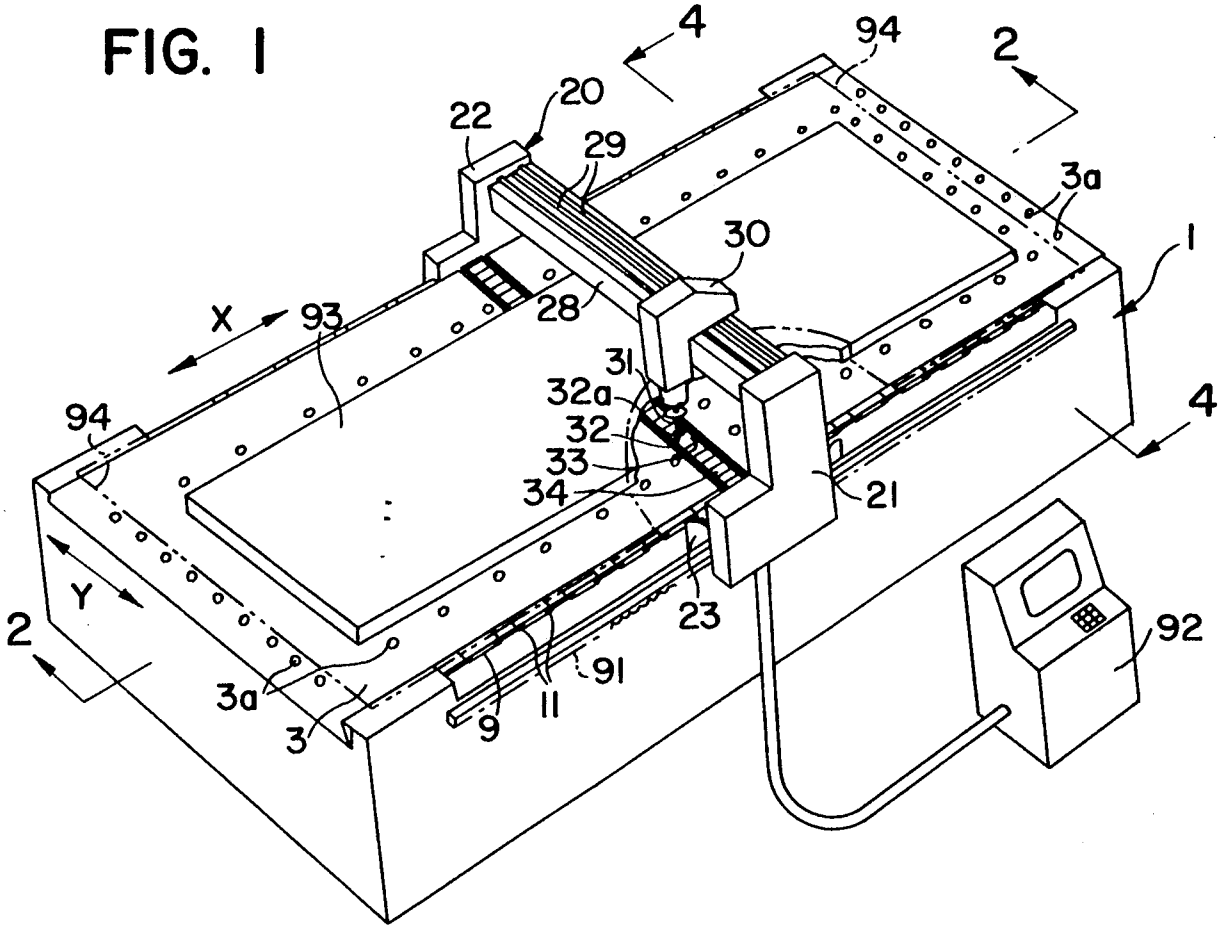
FIG. 1 is a perspective view showing a laminate cutting apparatus according to one embodiment of the present invention.

One embodiment of the present invention will now be described with reference to the drawings.

In FIGS. 1, 2, 3 and 4, the numeral 1 denotes a rectangular pedestal whose length in the longitudinal (X) direction is longer than that in the transverse (Y) direction. Two belt guides 2 extending in the transverse direction are horizontally secured onto the pedestal 1, one at a front end and the other at a rear end thereof. A flexible laminate supporting belt 3 is supported on the front and rear belt guides 2.

This supporting belt 3 curves downward from half-circular external portions of the front and rear belt guides 2, and both ends of the belt 3 are connected to take-up rollers 4 rotatably disposed across lower parts of front and rear end portions of the pedestal 1 respectively. Belt drive motors 5 are installed at the front and rear end portions of the pedestal 1. The supporting belt 3 is taken up on one of the take-up rollers 4 by the motors 5 through an endless chain or an endless belt.

The supporting belt 3 is formed of a flexible material such as a synthetic resin or a rubber. A number of vent holes 3*a*, each penetrating all the way through the thickness of the supporting belt 3, are arranged in parallel at predetermined spaces on the belt 3 in longitudinal and transverse directions, respectively.

A belt support mechanism 7 is disposed below the supporting belt 3. This belt support mechanism 7 is adapted to support the belt 3 at its portion other than a movable recess 6 and its vicinity which will be described later.

Figure 5:
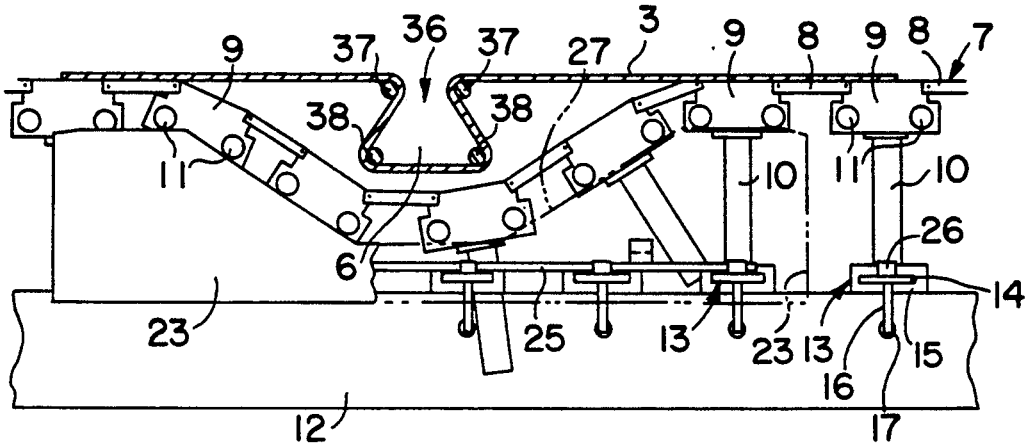
FIG. 5 is a partly enlarged explanatory view of FIG. 2.
Figure 6:
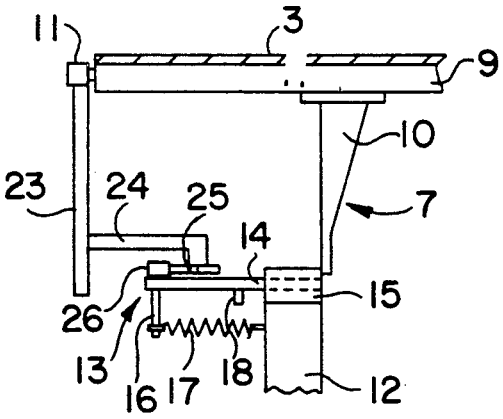
FIG. 6 is likewise a partly enlarged explanatory view of FIG. 4.

In the belt support mechanism 7, as also shown in FIGS. 5 and 6, a number of rectangular belt support plates 9 elongated in the transverse direction are arranged at generally equal spaces in the longitudinal direction below the supporting belt 3, the belt support plates 9 are pivotally connected to connecting members 8, respectively, so as to be free to flex in the vertical direction, and each of the belt support plates 9 is provided with a pair of support posts extending downward from both end portions thereof and also with two pairs of rollers 11, one pair being rotatably mounted on both sides of the front part thereof and the other pair being rotatably mounted on both sides of the rear part. The belt support plates 9 at front and rear ends are connected to the front and rear belt guides 2 through the connecting members 8 respectively so as to be free to flex in the vertical direction. The belt support plates 9 and the supporting belt 3 have the generally same width with each other. The belt support plates 9 and connecting portions 8 are provided with a predetermined amount of loosening as a whole.

The pedestal 1 is provided at a vertically intermediate portion thereof with a pair of longitudinal beams 12 extending in horizontal postures. Receiving plates 14 are retractably transversely inserted into and retained by the longitudinal beams 12 by a receiving plate retaining mechanism 13 opposing the support posts 10.

In the receiving plate retaining mechanism 13, a receiving plate holder 15 disposed below each belt support plate 9 is secured to the upper surface of the longitudinal beam 12, and the receiving plate 14 is transversely slidably fitted into and held by the receiving plate holder 15. A tension spring 17 is stretched between an external side surface of the longitudinal beam 12 and a pin 16 projecting downward from an external end of the receiving plate 14 in order to bias the receiving plate 14 transversely inwardly. The receiving plate 14 is provided at an under surface thereof with a stopper 18 adapted to abut with the external surface of the longitudinal beam 12.

Figure 3:
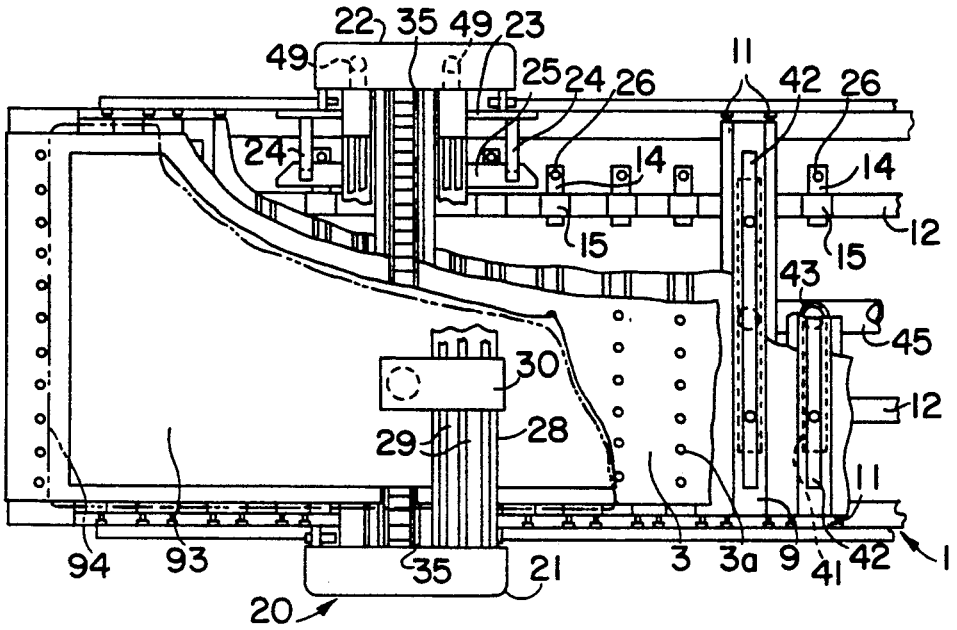
FIG. 3 is a plan view, partly exploded, of FIG. 1.

At a portion other than the movable recess 6 and its vicinity, as shown in FIG. 3, a lower end of the support post 10 attached to the belt support plate 9 is supported on the inner end of the receiving plate 14 inserted into the receiving plate holder 15, whereby the belt support plate 9 is maintained in its raised state. At the movable recess 6 and its vicinity, as shown in FIG. 6, the receiving plate 14 is retracted and the support post 10 is separated from the receiving plate 4, whereby the belt support plate 9 is lowered.

Figure 4:
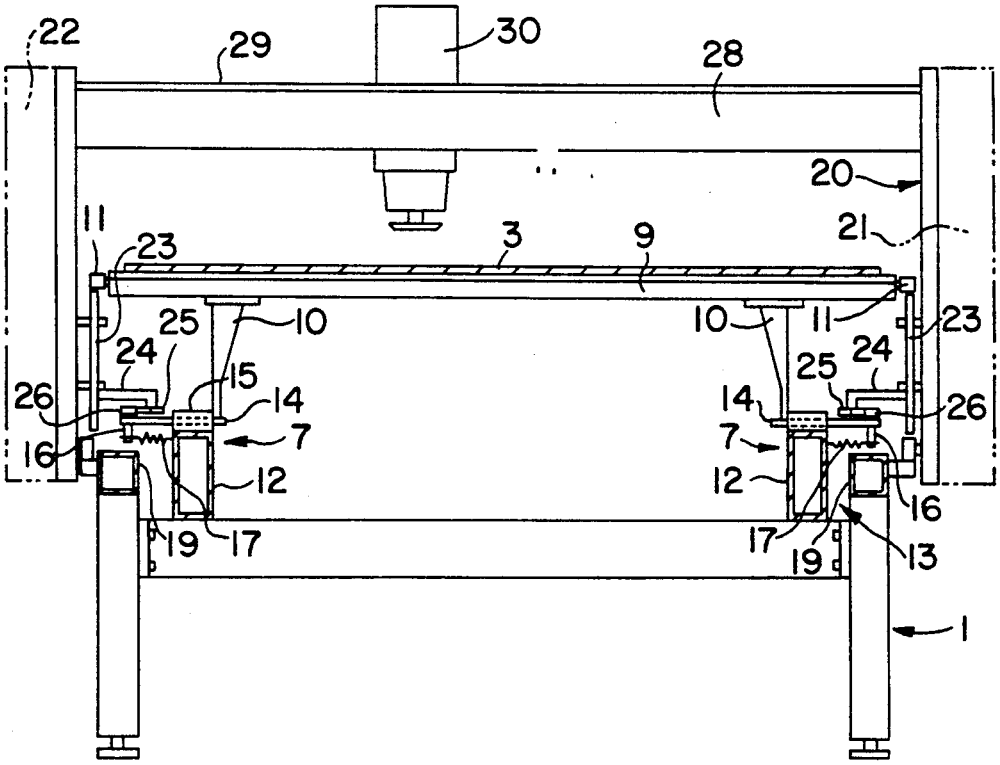
FIG. 4 is a sectional view of an important portion taken on line 4—4 of FIG. 1.

As shown in FIGS. 1 through 6, the pedestal 1 is provided with a travel body 20 capable of reciprocating in the longitudinal direction. The travel body 20 has both side members 21, 22 which are engaged with and supported by a pair of guide rails 19 disposed at external edge portions of the pedestal 1. Cam plates 23 are secured to lower end portions of the side members 21, 22 respectively. The cam plates 23, as shown in FIGS. 4, 5 and 6, are disposed outside of the guide rails 19 in such a manner as to support the rollers 11 of the belt support plates 9. Sweeping boards 25 of a trapezoidal shape in a plan view are secured to lower parts of the inner side of the cam plates 23 through mounting arms 24 respectively. Engaging rollers 26 of vertical shafts rotatably mounted on the external end portions of the receiving plates 14 are detachably engaged with the sweeping boards 25 from outside. A cam groove 27 of a trapezoidal shape having an open upper surface is formed in each cam plate 23.

A connecting beam 28 is provided to span the upper end portions of the side members 21, 22 of the travel body 20. A cutter head 30, which is capable of reciprocating in the transverse direction, is supported on a head rail 29 which is provided on the connecting beam 28 in parallel relation.

A knife-like cutter 31 is supported on a cutter head 30 so as to be raised and lowered and turnable about a vertical axis. The cutter 31 extends vertically below the cutter head 30. Disposed below the cutter 31 is a cutter receiving sleeve 32 which is provided with a cutter support hole into which a tip portion of the cutter 31 is retractably inserted. The cutter 31 is raised and lowered by a cutter elevating mechanism having a crank mechanism, a drive mechanism (not shown) or the like disposed within the cutter head 30.

The cutter receiving sleeve 32 disposed below the cutter 31 is engaged with and supported by a receiving sleeve retaining member 33 so as to be turnable about a vertical axis. On both sides of the receiving sleeve retaining member 33, a number of closure plates 34 are linked in the transverse direction.

At the lower end portions of the side members 21, 22 of the travel body 20, a lower portion receiving member 35 having a generally U-shape in section is provided to span the side members 21, 22 of the travel body 20. The receiving sleeve retaining member 33 and the closure plates 34 are engaged with and supported by an upper portion of the lower portion receiving member so as to be reciprocated in the transverse direction.

Figure 2:
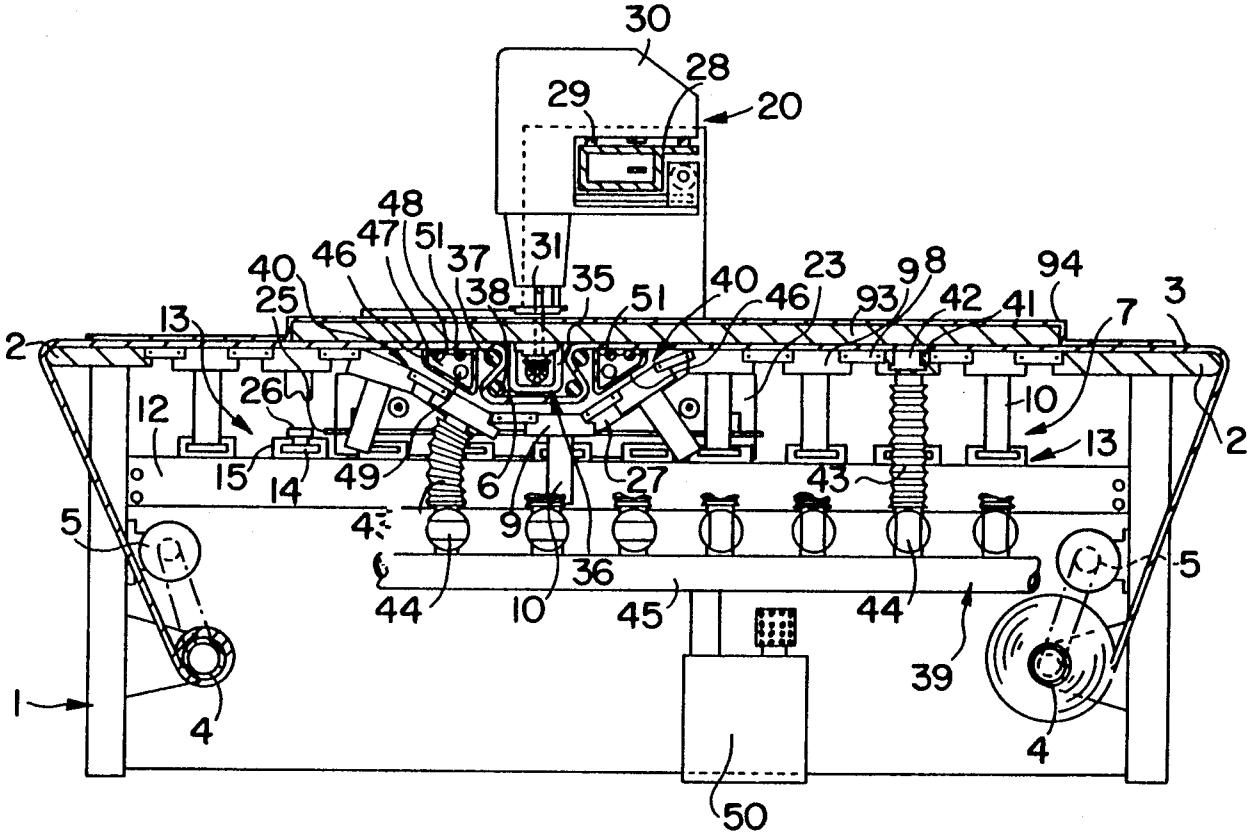
FIG. 2 is a vertical sectional view taken on line 2—2 of FIG. 1.

As shown in FIG. 2, a recess forming member 36 is disposed between the lower portions of the side members 21, 22 of the travel body 20. The recess forming member 36 has four recess forming rollers 37, 38, two at its upper part and two at its lower part, disposed below the supporting belt 3 in such a manner as to surround the lower portion receiving member 35, and both end portions of the recess forming rollers 37, 38 are rotatably supported by the side members 21, 22. The supporting belt 3 is supported by the two recess forming rollers 37 located above from under, and by the two recess forming rollers 38 located below from above. The movable recess 6, which has an open upper surface and which gradually becomes long in the longitudinal direction toward a bottom surface thereof, is formed in the supporting belt 3 over the entire width thereof in the transverse direction. The movable recess 6 is located above the cam groove 27 of the cam plate 23 in such a manner as to oppose the cam groove 27. The rollers 11 of the belt support plates 9 located within the movable recess 6 are supported on the upper surface of the cam groove 27 (see FIGS. 2 and 5).

This embodiment includes a first and a second suction mechanisms 39, 40 for sucking air from under the vent holes 3*a* formed in the supporting belt 3. In the first suction mechanism 39, a suction passage 41 is formed in each belt support plate 9 both ends of which project from both side edges of the supporting belt 3, a suction port 42 of the suction passage 41 is opened up at the upper surface of the belt support plate 9, the suction passage 41 is connected at a central portion thereof to a suction pipe 45 through an expansible bellows-like flexible hose 43 and an electromagnetic stop valve 44, and the suction pipe 45 with front and rear ends thereof closed is disposed below the supporting belt 3 and extends horizontally in the longitudinal direction.

The suction port 42 is formed in such position and such size as being able to communicate with all vent holes 3*a* arranged in parallel in the transverse direction of the supporting belt 3. The electromagnetic stop valve 44 is automatically closed by suitable electric means not shown while the belt support plate 9 is located at the cam groove 27 portion of the cam plate 23.

In the second suction mechanism 40, a front and a rear suction boxes 46 are disposed at location proximate to the front and rear ends of the movable recess 6 of the supporting belt 6 and where they do not interfere with the belt support plate 9 within the cam groove 27, and both ends of the suction boxes 46 are secured to the lower end portions of the side members 21, 22 of the travel body 20, respectively. A suction chamber 47 is formed in each suction box 46, a suction part 48 of the suction chamber 47 is opened at the upper surface of the suction box 46, the suction port 48 is formed in such position and such size as being able to communicate with all vent holes 3*a* arranged in parallel in the transverse direction of the supporting belt 3, and one end of the suction chamber 47 is connected to a suction piping 49.

The suction pipe 45 of first suction mechanism 39 is connected at an intermediate portion thereof to a suction source 50 such as a vacuum pump, while the suction piping 49 of the second suction mechanism 40 is connected to a suction source 50 through a flexible hose and a stop valve (both not shown).

The suction chamber 47 is provided at the suction port 48 portion with auxiliary rollers 51 for supporting the supporting belt 3, and the auxiliary rollers 51 are rotatably axially supported on the both side members 21, 22 of the travel body 20.

As shown in FIG. 7, in a drive system 52 of this embodiment, a Y-axis (transverse direction) moving motor 53 is secured to the side member 22 (see FIG. 1) of the travel body 20, a connecting shaft 54 is rotatably supported on bearings (not shown) which are mounted on the both side members of the travel body 20, a timing belt 57 is meshed with a toothed pulley 55 of the Y-axis moving motor 53 and a toothed pulley 56 of the connecting shaft 54, and an upper and a lower toothed pulleys 58, 59 are secured to the connecting shaft 54 at two locations thereof. The upper toothed pulley 58 is meshed with an upper timing belt 60. The upper timing belt 60 is bent into the horizontal direction from the vertical direction by intermediate pulleys 61, 61 so as to be guided horizontally in the Y-axis direction and supported on an upper tension pulley 62 rotatably mounted on the other side member of the travel body, and both ends of the timing belt 60 are connected to the cutter head 30. The lower toothed pulley 59 is meshed with a lower timing belt 63. The lower timing belt 63 is supported on a lower tension pulley 64 rotatably mounted on the other side member and connected at both ends thereof to the receiving sleeve retaining member 33. Owing to the foregoing arrangement, upon reversible driving of the Y-axis drive motor 53, the cutter head 30 are reciprocally moved in the transverse (Y-axis) direction in synchronism with the receiving sleeve retaining member 33 and cutter receiving sleeve 32 by a single motor.

A cutter motor 65 is secured to a suitable location of the travel body 20, a timing belt 71 is meshed with a toothed pulley 66 of the cutter motor 65 and toothed pulleys 69, 70 secured to one end portions of an upper and a lower spline shafts 67, 68 rotatably supported by the side members of the travel body 20 and extending in the longitudinal direction, the timing belt 71 is pushed and tensioned by an intermediate pulley 72. The upper and lower spline shafts 67, 68 are rotatably supported on bearings (not shown) mounted on the side members of the travel body 20.

The upper spline shaft 67 is engaged with a spline nut 73 such that the spline nut 73 can be moved in the axial (longitudinal) direction. The spline nut 73 is supported on a suitable location of the cutter head 30 such that the spline nut 73 is capable of rotating but incapable of longitudinal movement. A drive side bevel gear 74 is secured to the spline nut 73, and a driven side bevel gear 75 of a longitudinal axis supported on the cutter head 30 meshes with the drive side bevel gear 74. A toothed pulley 76 integral with the driven side bevel gear 75 and a toothed pulley 78 mounted on a cutter guide 77 are meshed with a timing belt 79. The cutter guide 77 is rotatably supported on the cutter head 30 in order to turn the cutter 31 about a vertical axis.

The lower spline shaft 68 is axially movably engaged with a spline nut (not shown) which is supported on the receiving sleeve retaining member 33 such that the spline nut is capable of rotating but incapable of moving in the longitudinal direction. A drive side bevel gear 80 is secured to the spline nut, and a driven side bevel gear 81 of a longitudinal axis meshed with the drive side bevel gear 80 is coaxially secured to the cutter receiving sleeve 32 which is rotatably axially supported on the receiving sleeve retaining member 33.

Upon reversible driving of the cutter motor 65, the cutter 31 and the cutter receiving sleeve 32 are reciprocally turned in unison through the upper and lower spline shafts 67, 68, etc., in order to properly control the cutting direction.

An X-axis (longitudinal) traveling motor 82 is secured to a suitable location of the travel body 20, a connecting shaft 83 is rotatably disposed on bearings (not shown) mounted on both side members of the travel body 20, a toothed pulley 84 of the X-axis traveling motor 82 and a toothed pulley 85 secured to one end portion of the connecting shaft 83 are meshed with a timing belt 86, and toothed pulleys 87 having the same number of tooth are secured to both end portions of the connecting shaft 83. The toothed pulley 87 and a toothed pulley 89 integral with a pinion 88 disposed thereunder are meshed with a timing belt 90. The pinion 88 mesh with rack bars 91 (see also FIG. 1) secured to the lower portions of the guide rails of the pedestal in parallel relation in the longitudinal direction. Owing to the foregoing arrangement, upon reversible driving of the X-axis driving motor 82, the travel body reciprocates on the travel body rail in the longitudinal (X-axis) direction.

The three motors 53, 65 and 82 used herein are servomotors capable of numerical control. Based on data preprogrammed in a control board 92 of FIG. 1, the Y-axis moving motor 53, cutter motor 65 and X-axis traveling motor 82 are controlled respectively, the cutter 31 is properly directed, and the travel body 20 is traveled in order to perform a cutting operation.

Next, the cutting operation to the laminate by the cutting apparatus of this embodiment will be described.

First, a laminate 93 consisting of multiple plies of a sheet material such as a fabric is placed on the upper surface of the supporting belt 3, the drive motor 5 of one of the take-up rollers 4 with the supporting belt 3 wound thereon is driven, the supporting belt 3 is paid out from the other take-up roller 4 to allow the first mentioned take-up roller 4 to take up in order to move the supporting belt 3 in the longitudinal direction to transfer the laminate 93 to a predetermined position, and the belt drive motor 5 is stopped.

Next, substantially whole part of the laminate 93 on the supporting belt 3 and upper surface of the supporting belt 3, which are exposed to atmosphere, are covered with a flexible air-impermeable sheet 94. In that state, the suction source 50 is driven, the electromagnetic stop valve 44 of the belt support plate 9 supported on the cam groove 27 of the cam plate 23 is closed, and all remaining electromagnetic stop valves 44 are opened to communicate the suction pipe 45 of the first suction mechanism 39 with the suction passage 41 of the belt support plate 9 through the flexible hose 43, whereby air is sucked from the suction ports 42 of the belt support plates 9 located in position other than the cam groove 27 portion via the vent holes **3*a* of the supporting belt 3. Simultaneously, by causing the suction source 50 to be communicated with the suction chamber 47 of the second suction mechanism 40, air is sucked from the suction ports 48 of the suction chamber 47 via the vent holes 3*a* of the supporting belt 3. By sucking action of air from the suction ports 42, 48, the laminate 93 and the air-impermeable sheet 94 are held on the supporting belt 3, and the whole laminate 93 is uniformly compressed on the upper surface of the supporting belt 3**.

While maintaining the above state, the X-axis traveling motor 82 is driven to cause the travel body 20 to travel in the longitudinal direction, and the Y-axis moving motor 53 is driven to cause the cutter head 30 supported on the connecting beams 28 of the travel body 20 to move in the transverse direction in order to bring the cutter head 30 to a cutting start position on the laminate 93. At the same time, since the recess forming member 36 is moved in the longitudinal direction in accordance with the longitudinal traveling of the travel body 20, the movable recess 6 is also moved in the longitudinal direction. Along with the movement of the movable recess 6, the cam plate 23 is also moved in the longitudinal direction. Since the belt support plates 9 supported by the roller 11 on the upper surface of the cam groove 27 are changed, the electromagnetic stop valve 44 of the belt support plate 9, which is raised from the cam groove 27 portion, is opened. As a result, in accordance with the movement of the movable recess 6, the electromagnetic stop valve 44 of the belt support plate 9 are opened and closed.

Since the lower receiving member 35 is moved in the same direction as the travel body 20, the cutter receiving sleeve 32 is also moved in the same direction. Furthermore, the cutter receiving sleeve 32 is also moved in the transverse direction together with the closure plates 34 disposed at the lower receiving member 35 and the receiving sleeve retaining member 33 in synchronism with the transverse movement of the cutter head 30. As a result, the knife-like cutter 31 mounted on the cutter head 30 and the cutter receiving sleeve 32 are brought to cutting start position in such a manner as to vertically oppose each other.

The travel body 20, the cutter head 30, the lower receiving member 35, the receiving sleeve retaining member 33, etc. are stopped at the cutting start positions, and the cutter 31 is lowered by operating a cutter elevating mechanism (not shown). The cutter 31 is caused to penetrate into the upper portion of the laminate 93 of the air-impermeable sheet 94 and the laminate 93, with the tip portion thereof inserted into and supported by the support hole **32*a* of the cutter receiving sleeve 32**.

In the above state, the X-axis traveling motor 82 and the Y-axis moving motor 53 are driven in accordance with a command from the control board 92, in order to move the cutter 31 and cutter motor 65 in unison, and the cutter 31 and the cutter receiving sleeve 32 are turned in the same direction in unison to properly direct the cutting edge of the cutter 31 in the proceeding direction, and at the same time, the laminate 93 is automatically cut together with the air-impermeable sheet 94 in accordance with a pattern based on the data preprogrammed in the control board 92.

After completion of the cutting to the laminate 93, the motors 53, 65 and 82 are stopped to raise the cutter 31 again. By repeating the afore-mentioned actions, cutting of a plurality of patterns is usually performed with respect to a single laminate 93. After completion of cutting of all patterns, the suction source is stopped, the belt drive motor 5 is driven to move the supporting belt 3 in the longitudinal direction, and the laminate 93 is removed from the supporting belt 3 so as to be transported.

The cutting apparatus of this embodiment has the belt support mechanism 7 in which the supporting belt 3 is supported on the four recess forming rollers 37, 38 of the recess forming member 36 disposed at the lower part of the travel body 20, the longitudinally movable recess 6 is formed in a part of the supporting belt 3, the travel body 20 is provided at the lower part thereof with the lower receiving member 35 on which the transversely movable cutter receiving sleeve 32 is supported through the receiving sleeve retaining member 33, and the lower receiving member 35 is disposed within the movable recess 6. Accordingly, the belt support mechanism 7 is capable of supporting the lower surface of the supporting belt 3 including the movable recess 6 which is moved in accordance with the traveling of the travel body 20.

In this belt support mechanism 7, a number of belt support plates 9 are linked in the longitudinal direction so as to be free to flex, the front and rear belt guides 2 other than the movable recess 6 and its vicinity of the under surface of the supporting belt 3 are supported by these support plates 9, the support posts 10 extending downward from the belt retaining plates 9 are supported on the receiving plates 14, which are retractably inserted into and retained by the horizontal longitudinal beams 12 extending in the longitudinal direction of the pedestal 1 through the receiving plate retaining mechanism 13, at the movable recess 6 and its vicinity of the supporting belt 3 (i.e., a portion other than the cam groove 27 portion), and the four rollers 11 mounted on the belt support plates 9 are supported on the upper surface of the cam grooves 27 of the cam plates 23 secured to the side members 21, 22 of the travel body 20 at the cam groove 27 portion. Accordingly, the cam plates 23 and the sweeping plates 25 secured thereto are moved in unison with the travel body 20, and the sweeping plates 25 and the receiving plates brought to the cam groove 27 location are engaged with each other through the engaging rollers 26, and the receiving plate 14 opposing the cam groove 27 is retracted.

As a consequence, the receiving plate 14 is separated from the support post 10 which has been brought to the cam groove 27 portion, to lower the belt support plate 9, the belt support plate 9 located at the cam groove 27 portion is supported on the upper surface of the cam groove 27 by the roller 11, and the belt support plate 9, which has come out of the cam groove 27 portion, is raised again by supporting the support post 10 on the receiving plate 14 inserted as a result of disengagement between the sweeping board 25 and the engaging roller 26 of the receiving plate retaining mechanism 13.

That is, each cam plate 23 has horizontal portions at front and rear parts of the cam groove 27, and after the roller 11 of the belt support plate 9 moving in the longitudinal direction climbs over the horizontal portions, the engaging roller 26 of the receiving plate retaining mechanism 13, the receiving plate 14 is retracted outwardly in the transverse direction against the tension spring 17 in order to remove the supporting relation between the receiving plate 14 and the support post 10, and the belt support plate 9 is lowered.

After the belt support plate 9 is brought out of the cam groove 27 and climbs over the horizontal portions of the cam plate 23, the engaging roller 26 is separated from the sweeping plate 25, the tension spring 17 inserts the receiving plate 14 inwardly in the transverse direction by its restoring force, the support post 10 is brought onto the receiving plate 14 as a result of the climbing of the roller 11 over the horizontal portions, and when the support post 10 is brought to the front and rear parts of the cam plate 23, the lower end of the support post 10 is supported by the receiving plate 14.

It is preferable that each cam plate 23 is provided at front and rear end portions of its upper surface with curved portions or inclined portions respectively, and when the roller 11 is brought to the horizontal portion of the cam plate 23, it is slightly higher than the belt support plates 9 which are located at front and rear parts of the cam plate 23.

Therefore, in accordance with the traveling of the travel body 20, the cam plate 23 and the recess forming member 36 are moved in unison, the movable recess 6 and the cam groove 27 are moved in the longitudinal direction in unison, the belt support plate 9 is supported on the upper surface of the cam groove 27 and guided to the vicinity of the movable recess 6 and then lowered at a good timing, thus enabling to avoid unfavorable interference with the movable recess 6, and when separated from the movable recess 6 and its vicinity, the belt support plate 9 is surely raised to support the supporting belt 3 in a horizontal posture. Moreover, in this embodiment, since the suction boxes 46 of the second suction mechanism 40 are disposed at location proximate to the front and rear ends of the movable recess 6 in the cam groove 27 respectively and the supporting belt is further supported by the auxiliary rollers 51 disposed across the suction boxes 46, the under surface of the supporting belt 3 can be supported reliably.

Furthermore, in this embodiment, the number of vent holes **3*a* formed in the supporting belt 3 are communicated with the suction ports 40 formed in the upper surface of the support plates 9 at a portion other than the movable recess 6 and its vicinity, while in the vicinity of the movable recess 6, the vent holes 3*a* are communicated with the suction ports 47 of the front and rear suction boxes 46, and only the electromagnetic stop valves 44 located between the suction ports 40 of the belt support plates 9 located at the movable recess and its vicinity and the suction source 50 are closed and all the remaining suction ports 40 and 47 are communicated with the suction source 50. Owing to the foregoing arrangement, air can be sucked almost uniformly from each part of the under surface of the laminate 93 loaded on the supporting belt 3, the whole laminate 93 can be held on the upper surface of the supporting belt 3 in the uniformly compressed state, and the tip portion of the cutter 31 can be inserted into and retained by the cutter receiving sleeve 32 (in this way, the cutter 31 is supported at two locations), thus also enabling to prevent deformation or twisting of the cutter 31** during cutting operation. As a result, a cut product of high accuracy can be obtained.

In this embodiment, instead of the electromagnetic stop valves 44 disposed between the flexible hoses 43 and the suction pipe 45, stop valves automatically closed by mechanical means while the belt support plates 9 are at the cam groove 27 portion of each cam plate 23 may be used.

In this embodiment, as shown in FIG. 8, the supporting belt 3 may be suitably modified as one (disclosed in the prior application filed Nov. 27, 1991) in which a suction passage 3*e* is formed between a lower air-permeable member 3*b* and an upper air-permeable member 3*d* supported on projections 3*c* projecting from the upper surface of the member 3*b* so that suction ducts (not shown) disposed on both side portions of the support belt 3 are communicated with the suction passage 3*e*.

Figure 9:
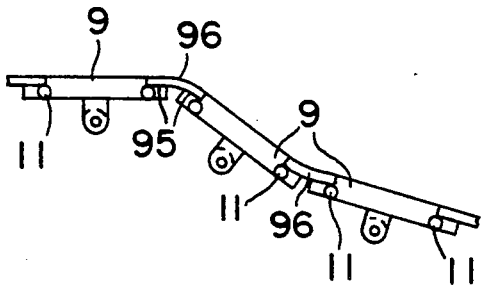
FIG. 9 is a partial side view showing a modified example of a support plate connecting member of the present invention.

In a modification of the present invention, the belt support plates, as shown in FIG. 9, may be designed such that cutout step portions 95 are formed at front and rear edges on their upper surfaces, and flexible connecting belts 96 each having a thickness equal to the depth of each step portion 95 are secured to the adjacent cutout step portions 95 of the belt support plates 9 by suitable means so that the adjacent belt support plates 9 can be linked so as to be free to flex.

Figure 10:
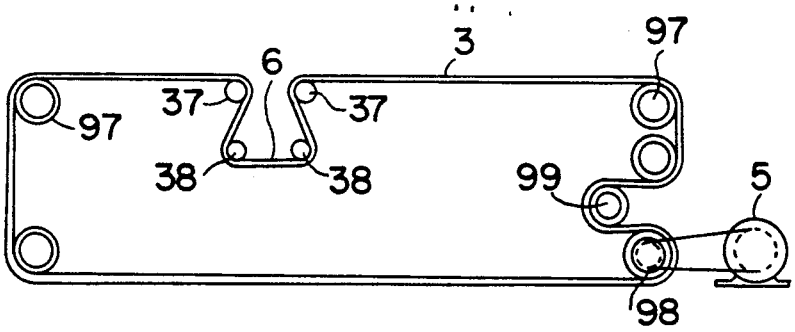
FIG. 10 is a side view showing a modified example of a supporting belt of the present invention.

In another modified embodiment of the present invention, as shown in FIG. 10, an endless supporting belt 3 is used, the upper portion of this supporting belt 3 is supported by a front and a rear carrier rollers 97, and a drive roller 98 driven by a belt drive motor 5 is urged to the inner peripheral surface of the supporting belt 3 by a tension roller 99, so that the supporting belt 3 is moved in the longitudinal direction owing to rotation of the drive roller 98.

In the above mentioned embodiments of the invention, although drive force is transmitted from the motor using the timing belt and toothed pulleys, the drive force may be transmitted using a ball screw shaft, a chain, etc.

Further, in the present invention, it may be provided an arrangement in which the longitudinal beams of the pedestal are provided at suitable location with through-holes extending in the transverse direction and the receiving plates are slidably inserted into and retained by these through-holes. The receiving plate retaining mechanism and the sweeping plates are not limited to the constructions of the above embodiments, and they can be suitably modified.

Figure 11:
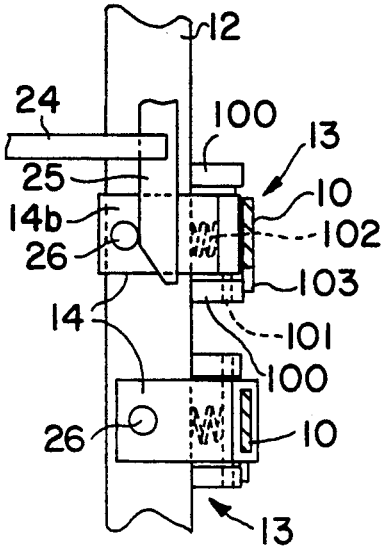
FIG. 11 is a partial plan view showing a modified example of receiving plates and receiving plate retaining mechanism.
Figure 12:
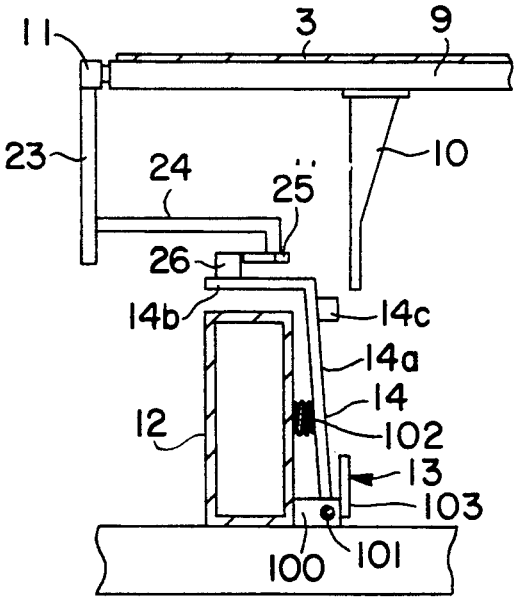
FIG. 12 is a partial cross sectional view showing receiving plates and a receiving plate retaining mechanism according to the modified example of FIG. 11.

That is, FIGS. 11 and 12 show a modified example of the receiving plates 14 and the receiving plate retaining mechanism 13. The receiving plate retaining mechanism 13 is provided a pair of front and rear fulcrum receivers disposed below of the belt support plates 9, these fulcrum bearers 100 are secured to a lower end portion of the longitudinal beam 12, a fulcrum shaft 101 is disposed between the fulcrum receivers 100 in order to span them, a lower end portion of a handing portion 14*a* of each receiving plate 14 is transversely pivotably attached to the fulcrum shaft 101, a compression spring 102 for biasing the receiving plate in the inserting direction is interposed between the transverse beam 12 and the hanging portion 14*a* of each receiving plate 14, and a stopper plate 103 is secured to at least one fulcrum receiver.

In each receiving plate 14, the hanging portion 14*a* is bent downward generally at acute angle from an inner end of the horizontal portion 14*b* disposed on the longitudinal beam 12, the hanging portion 14*a* is provided with a receiving metal piece 14*c* projecting inward and adapted to support the lower end of the support post 10, and engaging rollers 26 for a longitudinal axes are disposed on the outer end portion of the horizontal portion 14*b*. The remaining construction and basic operation of this modified example other than those described above are the same as in the embodiments shown in FIGS. 2 through 6.

In accordance with the longitudinal traveling of the travel body, the sweeping plates 25 are moved in the longitudinal direction together with the cam plates 23. At location other than the movable recess and its vicinity of the supporting belt 3, i.e., a portion other than the cam grooves of the cam plates 23, the support posts 10 of the belt support plates 9 are supported on the receiving metal pieces 14*c* of the receiving plates 14, while at the cam groove portions of the cam plates 23, the sweeping boards 25 secured to the cam plates 23 and the receiving plates 14 which are brought to the cam groove position are engaged with each other through the engaging rollers 26 respectively in order to turn the receiving plates 14 opposing the cam grooves about the fulcrum shafts 101 against the force of the compression springs 102 respectively, and as shown in FIG. 12, the receiving metal piece 14*c* of each receiving plate 14 is retracted so as to be separated from the support post 10 to allow the belt support plate 9 to be lowered.

The belt support plate 9 came out of the cam groove of each cam plate 13 is raised again by the restoring force of the compression spring 102 caused as a result of disengagement between the sweeping board 25 and the engaging roller 26 and supported on the receiving metal piece 14*c* of the receiving plate 14.

In this embodiment, a sheet of paper having an air-permeating property or a sheet of paper provided with a number of vent holes may be placed, where necessary in view of working, on the under surface of the laminate as an underlaying paper, so that the laminate is supported on the supporting belt through the underlaying paper and a cutting operation is performed in that state.

As described in the foregoing, in the laminate cutting apparatus according to the present invention, a laminate formed of a sheet material such as a fabric is placed on the laminate supporting belt at a predetermined location thereof, a large part of the portion of this laminate which exposes to atmosphere is covered with a flexible air-impermeable sheet, and in that state, by sucking air from the suction ports of the suction ducts, the laminate is supported on the supporting belt in the compressed state together with the air-impermeable sheet.

While maintaining this state, the knife-like cutter is penetrated into the laminate, the tip portion of the cutter is penetrated into and retained by the cutter receiving sleeve, and in accordance with the transverse movement of the cutter head mounted on the travel body and with the longitudinal travel of the travel body, the movable recess portion formed in the supporting belt and the cutter receiving sleeve disposed in the movable recess are moved in the longitudinal and transverse directions in unison with the travel body and the cutter head in order to cut the laminate.

In the present invention, since the cutter is supported at two locations and cutting is performed in that state, deformation caused by twisting of the cutter is seldom even when a complicated shape including an acute angle is required to be cut using a thin cutter. Therefore, a cut product of high accuracy can be obtained.

Furthermore, in the present invention, a number of belt support plates disposed at the belt retaining mechanism is linked in the longitudinal (forward and backward direction) so as to be free to flex, these belt support plates may be simply provided with belt support plates projecting downward and the rollers supported on the upper surface of the cam groove, and the structure of the receiving plate retaining mechanism, in which the receiving plates are retractably inserted into the longitudinal beams of the pedestal, is simple. Therefore, it is not necessary that the number of belt support plates are provided with rack bars, pinions and brakes, which naturally makes the construction of the present invention simpler than that of the conventional belt retaining mechanism. Moreover, contrary to the one disclosed in the prior patent application filed by the present applicant on Nov. 27, 1991, in which a number of carrier plates superposed in the transverse direction are provided and thus the dimension of the apparatus in the transverse direction is large and the weight thereof is heavy, the apparatus of the present invention can be made small in size and light in weight because the carrier plates are not required.

Furthermore, in the present invention, the belt support plates supporting the lower surface of the laminate supporting belt are linked in the longitudinal direction so as to be free to flex, the receiving plates are retractably inserted into the horizontal longitudinal beams disposed along the pedestal in the longitudinal direction through the receiving plate retaining mechanism, the support posts extending downward from the belt support plates are supported on these receiving plates at a portion (or location) other than the movable recess and its vicinity respectively, and the rollers disposed on the belt supporting plates are supported on the upper surface of the cam groove of each cam plate secured to the travel body respectively at the movable recess and its vicinity. Accordingly, the cam plates and the sweeping boards are moved in unison with the travel body, and the receiving plate retaining mechanism brought to the location of the sweeping boards and cam plates are brought into engagement in order to retract the receiving plates opposing the cam grooves. By this, the receiving plates are separated or removed from the support posts brought into the movable recess and its vicinity in order to lower the belt support plates, the belt support plates located at the movable recess and its vicinity are supported on the upper surface of each cam groove through the rollers, and the belt support plates brought out of the movable recess and its vicinity are raised again by supporting the support posts on the receiving plates which are inserted into the longitudinal beams as a result of disengagement between the sweeping plate and the retaining mechanism.

Accordingly, the belt support plates can normally be supported in a horizontal posture stably and reliably. Since the belt support plates can be raised and lowered by mechanical means through the cam groove portion without using any electric means, a troubleless and stable cutting operation can be performed.

What is claimed is:

1. A laminate cutting apparatus, comprising: a pedestal having front and rear end portions; a laminate supporting belt mounted on said pedestal through a belt support mechanism, said belt being capable of reciprocating longitudinally; a travel body including two side members supported on said pedestal and capable of reciprocating longitudinally; said travel body being provided with a recess forming member for forming a movable recess having an open upper surface in said supporting belt, a cutter head capable of reciprocating transversely above said supporting belt, a cutter receiving sleeve capable of reciprocating transversely within said movable recess in synchronism with said cutter head; a knife-like cutter mounted on said cutter head with a tip portion thereof inserted into said cutter receiving sleeve such that said cutter is capable of moving up and down; and a suction mechanism for compressing a laminate on said supporting belt; wherein said belt support mechanism comprises: a number of belt support plates linked in the longitudinal direction so as to be free to flex and adapted to support an under surface of said supporting belt, said number of linked belt support plates having front and rear end plates connected, respectively, to said front and rear end portions of said pedestal; a pair of horizontal longitudinal receiving beams disposed along the longitudinal direction of said pedestal; a number of receiving plates retained by said longitudinal beams so as to be capable of being inserted and retracted from a receiving plate retaining mechanism; a pair of support posts extending downward from each of said belt support plates and supported by said receiving plates; cam plates secured to both side members of said travel body and each cam plate provided with a cam groove surrounding said movable recess; rollers disposed on the ends of said belt support plates transverse to said longitudinal direction, said rollers being supported on upper surfaces of said cam plates; and sweeping boards secured to said both side members of said travel body, which engage said receiving plate retaining mechanism to retract said receiving plates when said receiving plates oppose said cam grooves.

* * * * *